US005836279A

United States Patent [19]

Strauss

[11] Patent Number: 5,836,279

[45] Date of Patent: Nov. 17, 1998

[54] DEVICE FOR VARYING THE OPENING AND CLOSING TIMES OF GAS EXCHANGE VALVES OF AN INTERNAL COMBUSTION ENGINE

[75] Inventor: Andreas Strauss, Herzogenaurach, Germany

[73] Assignee: INA Walzlager Schaeffler oHG, Germany

[21] Appl. No.: 50,403

[22] Filed: Mar. 30, 1998

[30] Foreign Application Priority Data

May 21, 1997 [DE] Germany ..... 197 21 209.3

[51] Int. Cl.[6] ..... F01L 1/344

[52] U.S. Cl. ..... 123/90.17; 123/90.31; 123/90.37; 74/568 R; 464/2

[58] Field of Search ..... 123/90.15, 90.17, 123/90.31, 90.33, 90.34, 90.37; 74/567, 568 R; 464/1, 2, 160, 161

[56] References Cited

U.S. PATENT DOCUMENTS

| | | | |
|---|---|---|---|
| 5,090,365 | 2/1992 | Hotta et al. | 123/90.17 |
| 5,201,289 | 4/1993 | Imai | 123/90.17 |
| 5,309,873 | 5/1994 | Suga et al. | 123/90.17 |
| 5,377,639 | 1/1995 | Nakadouzono et al. | 123/90.17 |
| 5,588,404 | 12/1996 | Lichti et al. | 123/90.17 |
| 5,727,508 | 3/1998 | Goppelt | 123/90.17 |

FOREIGN PATENT DOCUMENTS 43 21 003 1/1995 Germany .

*Primary Examiner*—Weilun Lo
*Attorney, Agent, or Firm*—Bierman, Muserlian and Lucas

[57] ABSTRACT

A device for varying the opening and closing times of gas exchange valves of an internal combustion engine, comprising a driven unit (2) rotationally fixed to an intake or exhaust camshaft, a drive unit (8) which is in driving relationship with a crankshaft through a traction element, and an adjusting piston (19) axially displaceable within a housing (10) and axially delimits two pressure chambers (22, 23) while being connected to a sliding sleeve (24) which is provided with two oppositely oriented helical gear sections (26, 28) which cooperate with complementary helical gearings (5, 16) on the driven unit (2) and the drive unit (8), said pressure chambers (22, 23) being sealed from each other by a piston sealing ring (21) and a sealing disc (31) arranged between the end faces (6, 17) of the driven unit (2) and the drive unit (8), a second sealing disc (36) being arranged next to the first sealing disc (31), the inner peripheral clearance of the second sealing disc (36) to the hub (3) is smaller than the mounting clearance of the drive unit (8) to the driven unit (2), and pressure medium leakages between the pressure chambers (22, 23) of the device (1) are sealed by the second sealing disc (36).

4 Claims, 2 Drawing Sheets

DEVICE FOR VARYING THE OPENING AND CLOSING TIMES OF GAS EXCHANGE VALVES OF AN INTERNAL COMBUSTION ENGINE

FIELD OF THE INVENTION

A device for varying the opening and closing times of gas exchange valves of an internal combustion engine, comprising a driven unit rotationally fixed to an intake or exhaust camshaft and constituted by a hub comprising a helical gearing, said device further comprising a drive unit which is in driving relationship with a crankshaft through a traction element and is mounted for rotation on the driven unit, said drive unit comprising a drive pinion having a housing rotationally fixed thereon and a second helical gearing, the device also comprising an adjusting piston which is axially displaceable by a hydraulic pressure medium between two end positions within the housing and which axially delimits two pressure chambers which can be connected alternately or simultaneously to a pressure medium feed duct and a pressure medium drain duct, said adjusting piston being made in one piece with a hollow cylindrical sliding sleeve having a first helical. gear section and, axially spaced therefrom, an oppositely oriented, second helical gear section, the first helical gear section cooperating with the complementary helical gearing on the driven unit and the second helical gear section cooperating with the complementary helical gearing on the drive unit, the two pressure chambers being sealed from each other by a piston sealing ring arranged on an end face of the adjusting piston and by a sealing disc which surrounds the hub of the driven unit while being arranged between opposing end faces of the driven unit and the drive unit, an outer periphery of the sealing disc bearing against an inner periphery of the sliding sleeve.

BACKGROUND OF THE INVENTION

In a device of the above type known from DE-OS 43 21 003, a piston sealing ring is arranged between opposing end faces of the drive and the driven units, the outer periphery of said piston sealing ring bearing sealingly against the inner periphery of the sliding sleeve, while the inner periphery of the piston sealing ring is float mounted on the driven unit. With the use of this piston sealing ring as a sealing means, it is intended to prevent the pressure medium, which serves for the alternating or simultaneous loading of the adjusting device, from flowing from the first chamber into the second chamber when not desired, or to a too great extent.

However, it has been determined in practice that, in an adjusting device of this type, highly excessive pressure medium leakages take place, especially when the adjusting piston is in one of its end positions. This is due to the fact that in the presence of oil pressure in the respective pressurized pressure chamber and in the pressure medium feed duct connected thereto, the piston sealing ring is pushed axially against the end face of the drive unit by the oil pressure. This can cause the pressure medium to flow into the respective pressureless pressure chamber through the annular gap being formed between the piston sealing ring and the end face of the driven unit and also under the piston ring through the radial gap formed by the piston ring with the driven unit due to its float mounting. The pressure medium may also flow through the mounting clearance between the drive unit and the driven unit into the pressure medium feed duct of the pressureless pressure chamber.

These pressure medium leakages cause a sinking of the supply pressure of the pressure medium which results in delayed adjusting times and an insufficient support of the adjusting piston for maintaining the adjusting angle of the camshaft which can manifest itself, for example, in an unstable idling of the internal combustion engine. Pressure medium leakages are particularly disadvantageous at high pressure medium temperatures because the viscosity and the supply pressure of the pressure medium are then particularly low so that the adjusting position of the camshaft required by the characteristic timing diagram of the engine has, frequently to be re-adjusted and/or higher pressure medium feed rates have to be provided.

OBJECTS OF THE INVENTION

It is an object of the invention to create a device for varying the opening and closing times of gas exchange valves of an internal combustion engine in which pressure medium leakages between the pressure chambers within the housing of the device are reduced to a minimum by simple and economic measures.

This and other objects and advantages of the invention will become obvious from the following detailed description.

SUMMARY OF THE INVENTION

A device of the invention for varying the opening and closing times of gas exchange valves of an internal combustion engine, comprising a driven unit rotationally fixed to an intake or exhaust camshaft and constituted by a hub comprising a helical gearing, said device further comprising a drive unit which is in driving relationship with a crankshaft through a traction element and is mounted for rotation on the driven unit, said drive unit comprising a drive pinion having a housing rotationally fixed thereon and a second helical gearing, the device also comprising an adjusting piston which is axially displaceable by a hydraulic pressure medium between two end positions within the housing and which axially delimits two pressure chambers which can be connected alternately or simultaneously to a pressure medium feed duct and a pressure medium drain duct, said adjusting piston being made in one piece with a hollow cylindrical sliding sleeve having a first helical gear section and, axially spaced therefrom, an oppositely oriented, second helical gear section, the first helical gear section cooperating with the complementary helical gearing on the driven unit and the second helical gear section cooperating with the complementary helical gearing on the drive unit, the two pressure chambers being sealed from each other by a piston sealing ring on an end face of the adjusting piston and by a first sealing disc which surrounds the hub of the driven unit while being arranged between opposing end faces of the driven unit and the drive unit, an outer periphery of the first sealing disc bearing against an inner periphery of the sliding sleeve, is characterized in that a second sealing disc surrounding the hub of the driven unit is arranged next to the first sealing disc between the end faces of the driven unit and the drive unit, an inner peripheral clearance of said second sealing disc to the hub is smaller than a mounting clearance of the drive unit to the hub of the driven unit, and pressure medium leakages between the pressure chambers of the device through an inner peripheral clearance of the first sealing disc are sealed by the second sealing disc.

With a second sealing disc surrounding the hub of the driven unit arranged next to the first sealing disc between the end faces of the driven unit and the drive unit, the inner peripheral clearance of said second sealing disc to the hub is smaller than the mounting clearance of the drive unit to the hub of the driven unit, and pressure medium leakages between the pressure chambers of the device through the inner peripheral clearance of the first sealing disc are sealed by the second sealing disc. Advantageous variants and embodiments of the invention can also contain independent, patentable features.

Thus, the advantage of the device of the invention over prior art devices is that the amount of leakage occurring between the pressure chambers of the device through the inner peripheral clearance of the first sealing disc are minimized to the greatest possible extent by the arrangement of a simple-to-mount and inexpensive second sealing disc next to the first sealing disc between the end faces of the drive and driven units. Although it is true that even in the case of the device of the invention, a pressurizing of one of the pressure chambers with oil pressure causes the first sealing disc to be pressed axially away from the end face of the driven unit so that the pressure medium can penetrate into the annular gap arising between the first sealing disc and the end face of the driven unit, a flow of the hydraulic medium under the first sealing disc into the unpressurized chamber is effectively prevented by the second sealing disc which surrounds the hub of the driven unit relatively snugly. This results in a permanently stable, pressure medium supply pressure and guarantees an adequate hydraulic support of the adjusting piston for holding the adjusting angle of the camshaft.

In an advantageous embodiment of the invention, both the inner periphery and the outer periphery of the second sealing disc are made smaller than the inner periphery and the outer periphery of the first sealing disc. The first sealing disc whose outer periphery bears sealingly against the inner periphery of the sliding sleeve thus, in a way, constitutes an upper seal between the end faces of the drive and the driven units, while the second sealing disc serves only as a lower seal between the said end faces, its outer periphery being of no functional importance.

Since the disadvantageous pressure medium leakages occur predominantly in the presence of oil pressure in the respective pressure chamber of the device which is pressurized at a given time, the second sealing disc is made, according to a further feature of the invention, preferably as a steel sealing ring arranged between the first sealing disc and the end face of the drive unit and connected to the hub of the driven unit firmly by an interference fit or loosely by a clearance fit. In the presence of oil pressure, the second sealing disc arranged in the aforesaid manner, is supported with one of its side faces on the end face of the drive unit, while the first sealing disc, which is also preferably made as a steel sealing ring and which, in conventional devices, bears against the end face of the drive unit, is pressed in the device of the invention against the other side face of the second sealing disc. A connection of the second sealing disc to the hub of the driven unit by a clearance fit has proved to be the most advantageous arrangement with regard to the relative ease of mounting and the adequate sealing action of this sealing disc. It is, however, also conceivable to make one or both of the sealing discs out of non-ferrous materials such as plastics or of brass or copper or alloys thereof.

Finally, in another embodiment of the device of the invention, the side faces of the first and the second sealing discs situated opposite each other are made as sealing surfaces for a mutual sealing of the two sealing discs. For this purpose, said opposing side faces of the two sealing discs which, as already mentioned, are pressed against each other in the presence of oil pressure in the camshaft-proximate pressure chamber of the device, are preferably made with parallel and flat surfaces to obtain the narrowest possible sealing gap and thus also a good sealing between the two sealing discs.

BRIEF DESCRIPTION OF THE DRAWINGS

The invention will now be described more closely with reference to the attached drawings wherein.

DETAILED DESCRIPTION OF THE DRAWINGS

Figure 1:
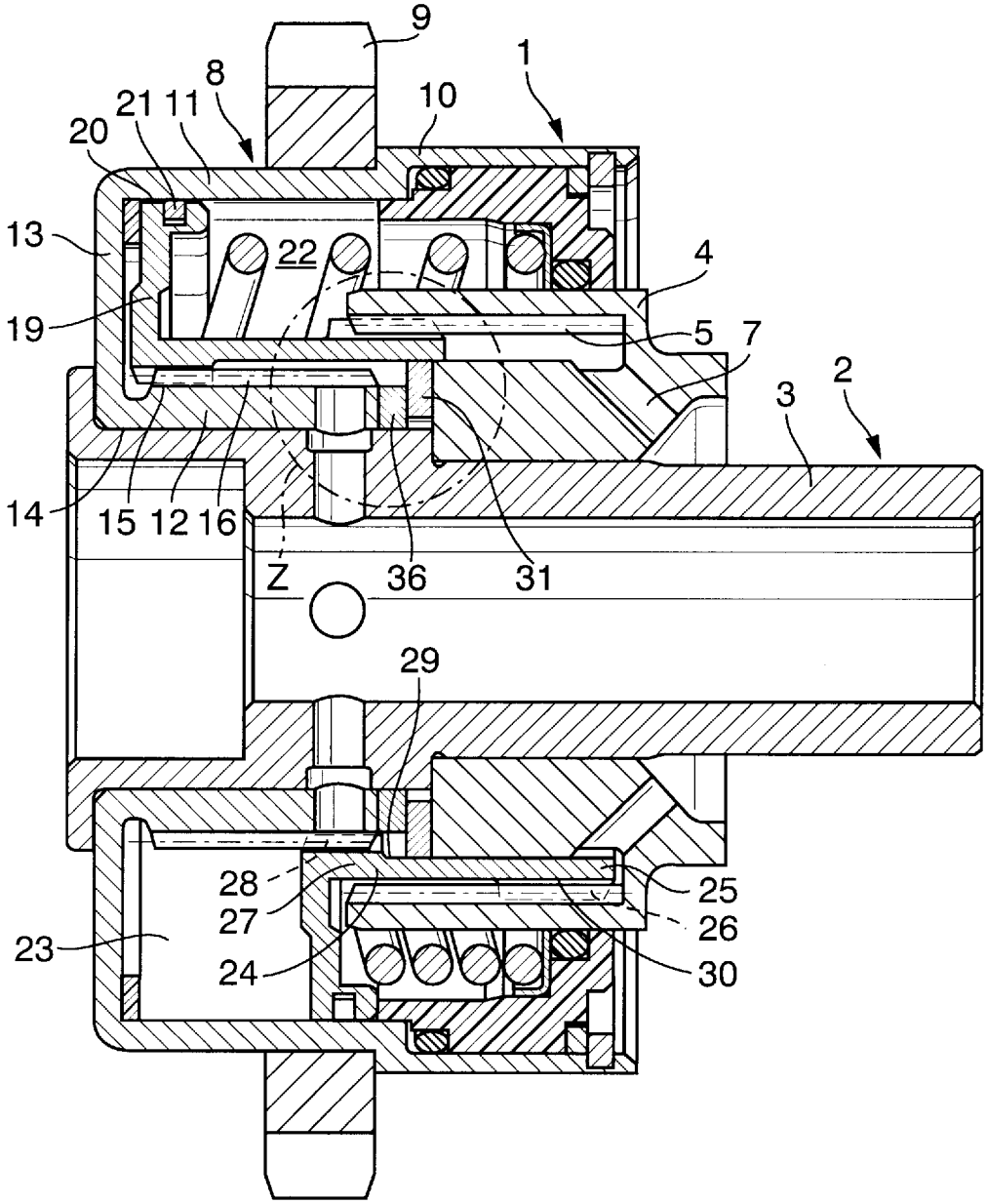
FIG. 1 is a longitudinal cross-section through a device sealed in accordance to the invention.

FIG. 1 shows a device 1 for varying the opening and closing times of gas exchange valves of an internal combustion engine. This device 1 generally comprises a driven unit 2 rotationally fixed to an intake or exhaust camshaft, not shown, and a drive unit 8 which is in driving relationship with a crankshaft, not shown, through a traction element. The driven unit 2 is consituted by a hub 3 having a helical gearing 5 which is arranged in the present example of embodiment, on an annular gear 4 which is rotationally fixed on the hub 3. The drive unit 8 comprises a drive pinion 9 on which a housing 10 is rotationally fixed, and a second helical gearing 16. It can be clearly seen in FIG. 1 that the housing 10 in the present embodiment has a U-shaped cross-sectional profile whose arms 11, 12 are parallel to the central longitudinal axis of the device 1 and whose web 13 is perpendicular to said axis. One of the arms 12 of the housing 10 is shortened at its free end and comprises the helical gearing 16 of the drive unit 8 on its inner peripheral surface 15. The outer peripheral surface 14 of the shortened arm 12 of the housing 10 radially surrounds the hub 3 of the driven unit 2 so that the drive unit 8 is rotatable about the driven unit 2.

FIG. 1 further shows that the device 1 further comprises an adjusting piston 19 which is axially displaceable by a hydraulic pressure medium between two end positions within the housing 10. The adjusting piston 19 axially delimits two pressure chambers 22, 23 which can be alternately or simultaneously connected to a pressure medium feed duct 7, 18 and a pressure medium drain duct, the adjusting piston 19 being made in one piece with a hollow cylindrical sliding sleeve 24 comprising two axially spaced, oppositely oriented helical gear sections 26 and 28. The first of these gear sections 26 is arranged on the edge portion 25 of the outer periphery 30 of the sliding sleeve 24 and cooperates with the complementary helical gearing 5 of the driven unit 2. The second gear section 28 is arranged on the edge portion 27 of the inner periphery 29 of the sliding sleeve 24 and cooperates with the complementary helical gearing 16 of the drive unit 8. By an application of pressure to one of the pressure chambers 22, 23, an axial movement can be transferred to the sliding sleeve 24 through the adjusting piston 19 so that, due to the helical gear sections 26, 28 on the sliding sleeve 24 and the helical gearings 5, 16 on the annular gear 4 and the housing 10, the drive unit 8 is rotatable relative to the driven unit 2.

Figure 2:
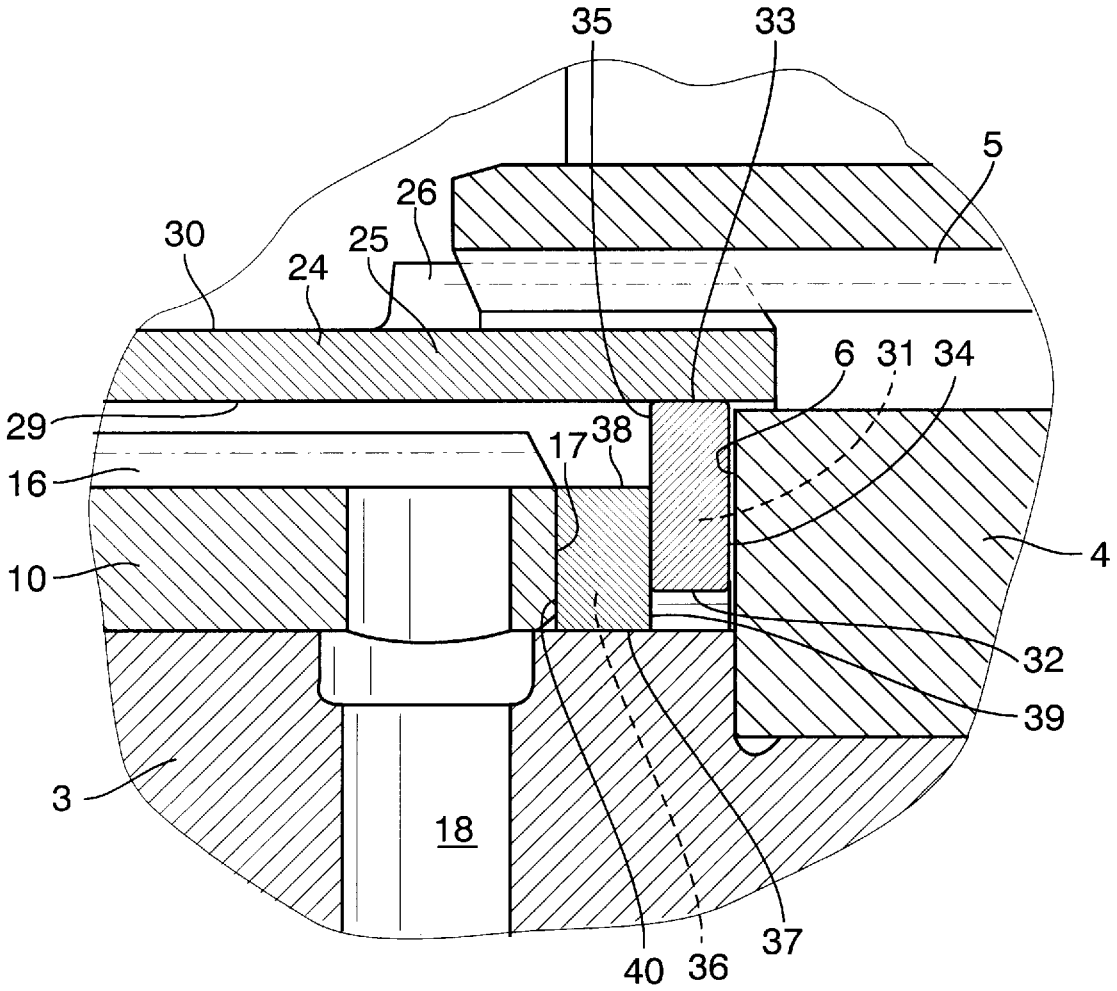
FIG. 2 shows the detail "Z" of FIG. 1

FIGS. 1 and 2 further show that the pressure chambers 22, 23 are sealed from each other on one side by a piston sealing ring 21 arranged on the end face 20 of the adjusting piston 19, and on the other side, by a sealing disc 31 which surrounds the hub 3 of the driven unit 2. The sealing disc 31 is disposed between opposing end faces 6, 17 of the driven unit 2 and the drive unit 8, respectively, and bears by its outer periphery 33 against the inner periphery 29 of the sliding sleeve 24.

The invention provides an additional sealing means in the form of a second sealing disc 36 disposed next to the first sealing disc 31 between the end faces 6, 17 of the driven unit 2 and the drive unit 8 and arranged, as can be clearly seen in FIG. 2, around the hub 3 of the driven unit 2. The inner peripheral clearance of this second sealing disc 36 to the hub 3 of the driven unit 2 is smaller than the mounting clearance of the drive unit 8 to the hub 3 of the driven unit 2, so that pressure medium leakages between the chambers 22, 23 of the device 1 through the inner peripheral clearance of the first sealing disc 31 are sealed. For this purpose, the inner periphery 37 and the outer periphery 38 of the second sealing disc 36 are made smaller than the inner periphery 32 and the outer periphery 33 of the first sealing disc 31. The second sealing disc 36 is made as a steel sealing ring and. arranged between the first sealing disc 31 and the end face 17 of the drive unit 8 and connected loosely to the hub 3 of the driven unit 2 by a clearance fit.

As can be seen in FIG. 2, the opposing side faces 35 and 39 of the first sealing disc 31 and the second sealing disc 36 respectively, are made flat and parallel to each other to form sealing surfaces of the sealing discs 31, 36 relative to each other. In the presence of oil pressure, the second sealing disc 36 of the invention bears with one side face 40 against the end face 17 of the drive unit 8, while the first sealing disc 31, which bears with one side face 34 against the end face 6 of the annular gear 4 of the driven unit 2, is pressed with its side face 35 against the other side face 39 of the second sealing disc 36. A flow of pressure medium through the gap, not referenced in FIG. 2, between the sealing disc 31 and the end face 6 of the annular gear 4 and under the sealing disc 31 into the camshaft-remote pressure chamber 22 of the device 1 is thus effectively prevented by the cooperation of the sealing disc 31 with the second sealing disc 36.

Various modifications of the device of the invention may be made without departing from the spirit or scope thereof and it is to be understood that the invention is intended to be limited as defined in the appended claims.

What I claim is:

1. A device for varying the opening and closing times of gas exchange valves of an internal combustion engine, comprising a driven unit (2) rotationally fixed to an intake or exhaust camshaft and constituted by a hub (3) comprising a helical gearing (5), said device further comprising a drive unit (8) which is in driving relationship with a crankshaft through a traction element and is mounted for rotation on the driven unit (2), said drive unit (8) comprising a drive pinion (9) having a housing (10) rotationally fixed thereon and a second helical gearing (16), the device also comprising an adjusting piston (19) which is axially displaceable by a hydraulic pressure medium between two end positions within the housing (10) and which axially delimits two pressure chambers (22, 23) which can be connected alternately or simultaneously to a pressure medium feed duct (7, 18) and a pressure medium drain duct, said adjusting piston (19) being made in one piece with a hollow cylindrical sliding sleeve (24) having a first helical gear section (26) and, axially spaced therefrom, an oppositely oriented, second helical gear section (28), the first helical gear section (26) cooperating with the complementary helical gearing (5) on the driven unit (2) and the second helical gear section (28) cooperating with the complementary helical gearing (16) on the drive unit (8), the two pressure chambers (22, 23) being sealed from each other by a piston sealing ring (21) on an end face (20) of the adjusting piston (19) and by a first sealing disc (31) which surrounds the hub (3) of the driven unit (2) while being arranged between opposing end faces (6, 17) of the driven unit (2) and the drive unit (8), an outer periphery (33) of the first sealing disc (31) bearing against an inner periphery (29) of the sliding sleeve (24), characterized in that a second sealing disc (36) surrounding the hub (3) of the driven unit (2) is arranged next to the first sealing disc (31) between the end faces (6, 17) of the driven unit (2) and the drive unit (8), an inner peripheral clearance of said second sealing disc (36) to the hub (3) is smaller than a mounting clearance of the drive unit (8) to the hub (3) of the driven unit (2), and pressure medium leakages between the pressure chambers (22, 23) of the device (1) through an inner peripheral clearance of the first sealing disc (31) are sealed by the second sealing disc (36).

2. A device of claim 1 wherein an inner periphery (37) and an outer periphery (38) of the second sealing disc (36) are made smaller than an inner periphery (32) and an outer periphery (33) of the first sealing disc (31).

3. A device of claim 1 wherein the second sealing disc (36) is made as a steel sealing ring arranged between the first sealing disc (31) and the end face (17) of the drive unit (8) and connected to the hub (3) of the driven unit (2) firmly by an interference fit or loosely by a clearance fit.

4. A device of claim 1 wherein side faces (35 and 39) of the first sealing disc (31) and the second sealing disc (36) situated opposite each other are made as sealing surfaces for a mutual sealing between the first sealing disc (31) and the second sealing disc (36).

* * * * *